United States Patent [19]

Roman

[11] 4,232,827

[45] Nov. 11, 1980

[54] ROCKING-ARM LAWN SPRINKLER

[75] Inventor: Gian F. Roman, Pasiano, Italy

[73] Assignee: Claber S.p.A., Fiume Veneto, Italy

[21] Appl. No.: 972,232

[22] Filed: Dec. 22, 1978

[30] Foreign Application Priority Data

Oct. 3, 1978 [IT] Italy ..... 22941/78[U]

[51] Int. Cl.[3] ..... B05B 3/16

[52] U.S. Cl. ..... 239/242; 220/319; 239/600

[58] Field of Search ..... 239/237, 240, 242, 600; 220/319

[56] References Cited

U.S. PATENT DOCUMENTS 3,105,639 10/1963 Jepson ..... 239/242

3,121,508 2/1964 Kase ..... 220/319 X 3,355,110 11/1967 Thompson ..... 239/242

*Primary Examiner*—Andres Kashnikow

*Attorney, Agent, or Firm*—Cushman, Darby & Cushman

[57] ABSTRACT

A lawn sprinkler is disclosed of the kind in which a tubular perforated rocking member dispenses irrigation water, the improvement consisting in that the mechanisms which impart to the tubular perforated member the rocking motion are enclosed in a sealed box the lid of which is conveniently removable, the gears and other component parts of the rocking mechanism being so arranged as to be capable of being individually removed and reassembled, each component part being univocally positioned. Thus maintenance, cleaning and replacement of the component parts of the rocking mechanism becomes both an easy and convenient operation.

4 Claims, 6 Drawing Figures

ROCKING-ARM LAWN SPRINKLER

This invention relates to a rocking-arm type lawn sprinkler for watering lawns, gardens and cultivated land in general.

The conventional rocking-arm lawn sprinklers provide for housing the gearings intended to produce the swinging motion (usually a turbine driven by the same stream of water and a set of drive-transfer gears) in the interior of a shielding and supporting sealed box. To open such box, provided that it is always possible, requires in the most favourable cases long and cumbersome overhauling operations consisting in removal of screws, nuts and other members intended for fastening and retaining the various component parts.

The results is that the conventional lawn-sprinklers, in addition to requiring time-consuming and cumbersome manipulations, render at least very difficult, if not even impossible, to have access to the motion-producing gear and more particularly to the gears proper in order to carry out upkeep, cleaning and/or replacement of some component part.

The principal object of the present invention is thus to provide a rocking-arm lawn sprinkler, which affords the opportunity conveniently to have access, and quickly, to the motion-producing assembly whenever such operations are required or desirable.

Another object of the present invention is then to provide a rocking-arm lawn sprinkler wherein the motion-producing system, in addition to being easily and conveniently accessible, is also so conceived as to permit very quick assembling and overhauling operations.

Having these objects in view, the lawn sprinkler according to this invention, which is of the kind comprising a rocking arm of tubular form with radial perforations therethrough, said arm having a closed end and the opposite end fed by irrigation water and borne for rotation by a box which encloses the motion-producing assembly actuated by the irrigation water itself, is characterized in the first place by the fact that said box has a rear lid which can be slipped out for giving access to the motion-producing gearing.

The provision of such slippable lid, as it is obvious, affords an easy and quick accessibility to the motion-produsing assembly so that periodic upkeep operations and, if, necessary, replacement operations of some faulty component part becomes possible.

The lawn sprinkler according to this invention, moreover, is preferably characterized by a quite particular arrangement of the motion-producing assembly which permits an easy and convenient initial assemblage and, when the lid is slipped out, an equally easy and convenient overhauling for upkeep and repair purposes. More detailedly, the motion-producing assembly, preferably comprises a turbine with a rotor freely and rotatably inserted onto a supporting arbor parallel to the direction of unslipping of the lid and a set of drive-transfer gears adapted to receive the drive from the turbine rotor to transfer such drive in the form of a continuous rotary motion to an output shaft mechanically connected to the rocking arm through a crank mechanism, said gear set being housed within a casing integral with said box and having a closing plate, and said turbine comprising a water-conveying wall integral with said lid and projecting therefrom to such a degree as to retain, when the lid is closed, said plate in a closed position, said lid having also integral therewith a tubular sleeve which, when the lid is closed, receives and supports for rotation said supporting arbor of the turbine rotor and is extended thereon to such a degree as to provide an abutment relationship with the rotor in order to prevent the rotor from being unslipped out of its arbor.

Such an arrangement of the motion-producing gearing enables the lid to maintain in the correct positions all the several component parts, which latter, on the other hand, can easily be removed and reassembled by merely slipping out the lid, then the rotor and finally the closure plate of the drive-transfer gear housing.

The features and advantages of the present invention will become fully apparent from the ensuing detailed description of a practical embodiment thereof which is shown by way of example only in the accompanying drawings; wherein.

Figure 1:
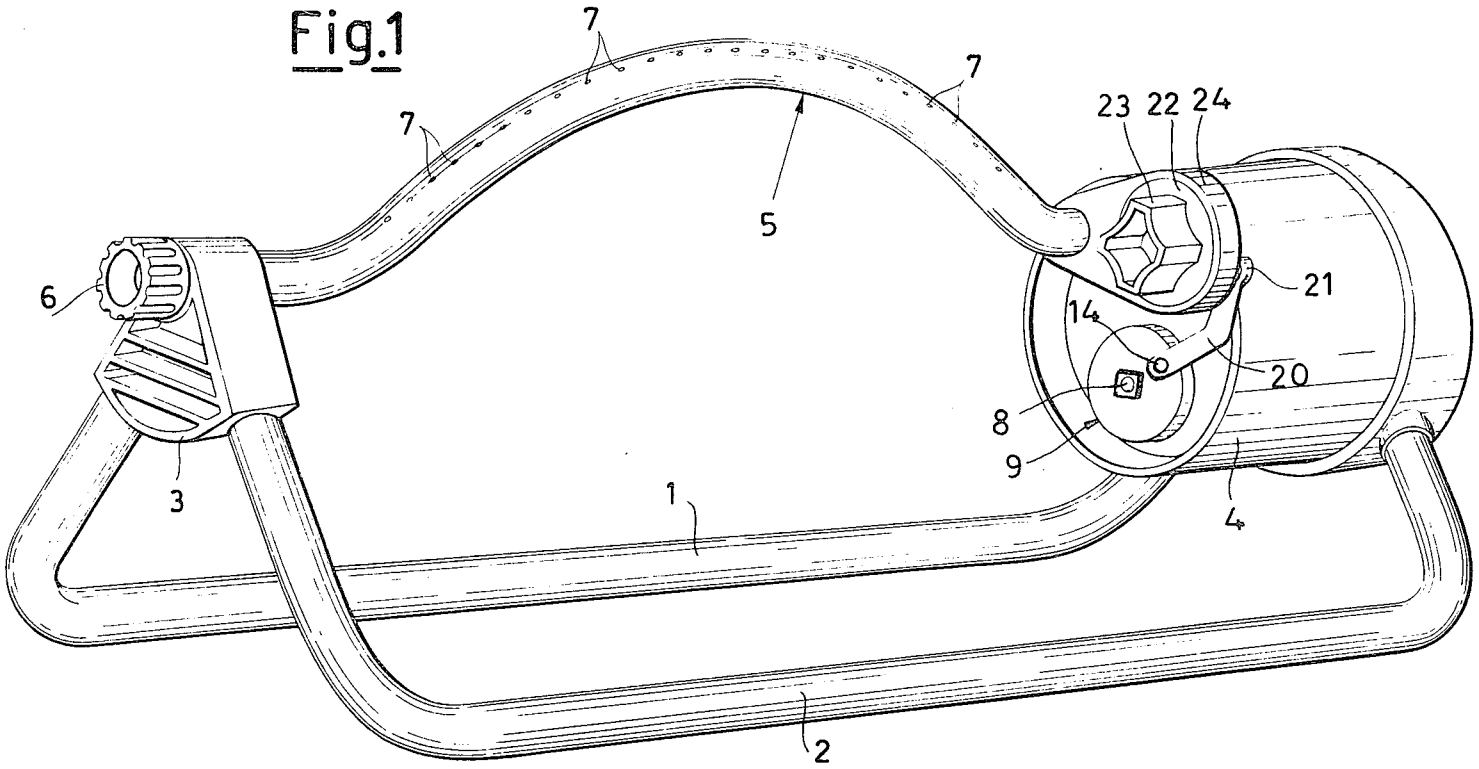
FIG. 1 is a perspective overall view of a rocking-arm lawn-sprinkler according to this invention.

The rocking-arm lawn sprinkler shown in FIG. 1 comprises a supporting structure composed by two U-bent metallic tubular pieces, 1 and 2 which slope towards one another and support with their converging ends an inverted-V supporting member 3 and a box 4 intended to hold a motion-producing assembly to be described in more detail hereinafter.

The supporting member 3 and the box 4 support for rotation a rocking tubular arm 5, either end of which is sealed by a plug 6, the arm having formed through its wall a regular array of radial pinholes which are set at an appropriate angle and are the sprinkling nozzles for the irrigation water.

Figure 2:
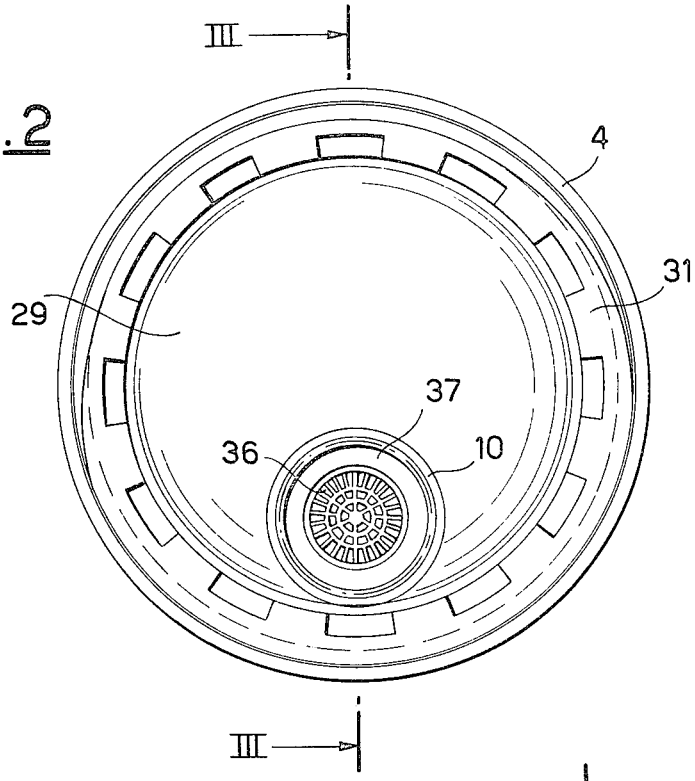
FIG. 2 is a showing of the box which contains the motion-producing assembly, as viewed from the side of the closing lid, that is along the direction of the arrow A of the FIG. 3.

Water is fed to the lawn-sprinkler through an inlet 10 placed on the back of the box 4 (FIGS. 3 and 2) and, through the box, is then conveyed, in the manner to be explained hereinafter, to the nearby end of the rocking arm 5, to be fed eventually into the interior of such arm.

The irrigation water itself, as will be explained hereinafter, also provides to energize the motion-producing assembly which is housed in the interior of the box 4. Such mechanism is terminated outside the box by an output shaft 8, on which is keyed a disc 9 which carries, in a radially slidable fashion, an eccentrical pin 14 (FIG. 1). A bellcrank lever 20 connects the pin 14 (which acts like a variable-eccentricity crankpin) to a dog 21 projecting from a disc 22, a manipulation knob 23 being integral with the disc 22. The latter disc 22 is supported for rotation by a journal 24 which is fastened overhangingly to the rocking arm 5, appropriate means (conventional and thus not shown) being inserted between the disc 22 and the journal 24 to enable the disc to be set from time to time in one of the several angular settings which can be selected by the agency of the knob 23.

As shown in FIGS. 2 to 6 inclusive, the box 4 houses in its interior a motion-producing assembly, which is actuated by the pressure of the water, and which basically comprises a turbine composed by a rotor 11 and a conveyance wall 12 and a set of drive-transfer gears composed by a first worm 15 integral with the arbor 13 of the rotor 11, a first pinion meshing with the worm 15, a second worm 17 coaxial with the wheel 16 and integral therewith, and a second pinion 18 meshing with the worm 17 and mounted solidly and coaxially on the output shaft 8.

The rotor 1 is idly mounted on the supporting pin 19 which is arranged along the axis of the box 4 (having a roughly cylindrical form) and is extended in a cantilever fashion from the front wall of the box. The worm 15 and the pinion 18 have thus the respective axes parallel to one another, whereas the pinion 16 and the worm 17 have their common axis arranged transversally, as best seen in FIG. 5.

Figure 3:
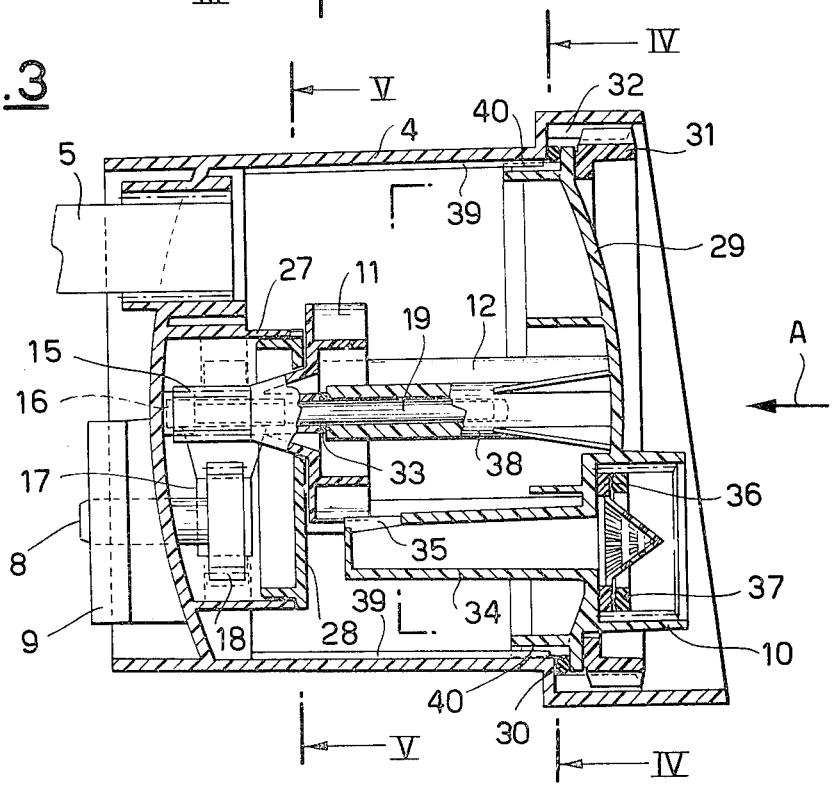
FIG. 3 shows the box in axial cross-sectional view, taken along the line III—III of FIG. 2.
Figure 4:
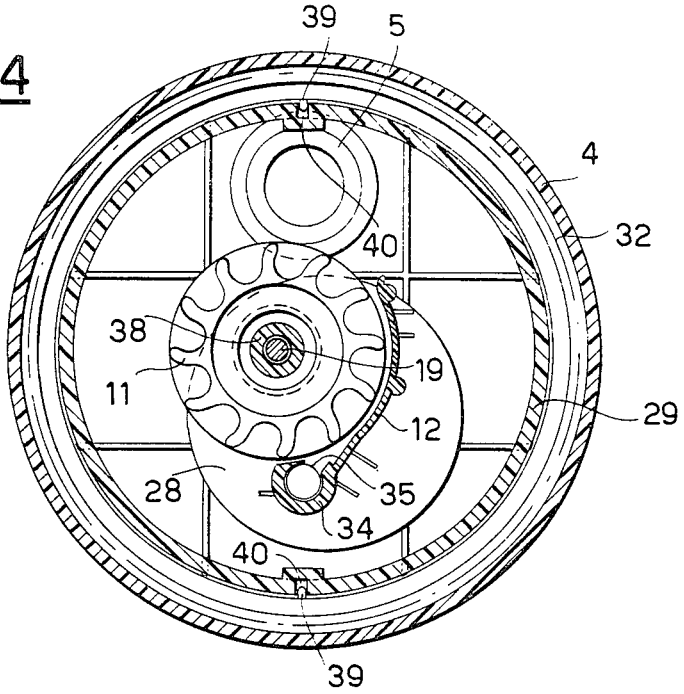
FIG. 4 shows the box in transversal cross-sectional view, taken along the line IV—IV of FIG. 3.
Figure 5:
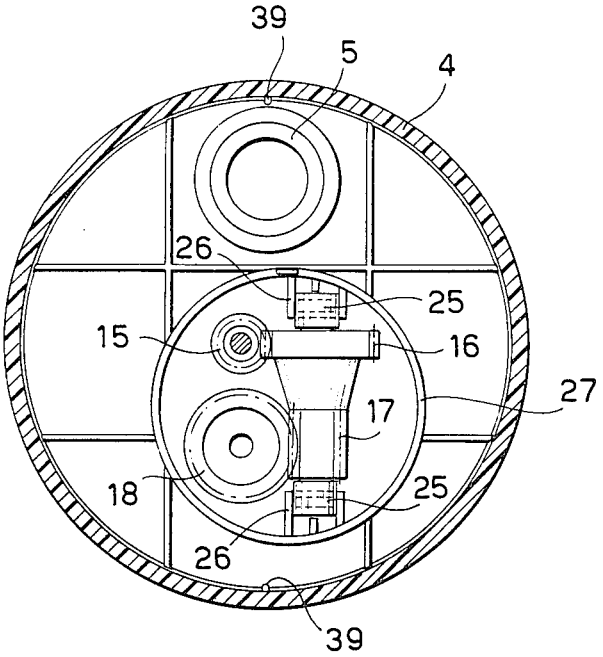
FIG. 5 shows the same box in transversal cross-sectional view, taken along the line V—V of FIG. 3.
Figure 6:
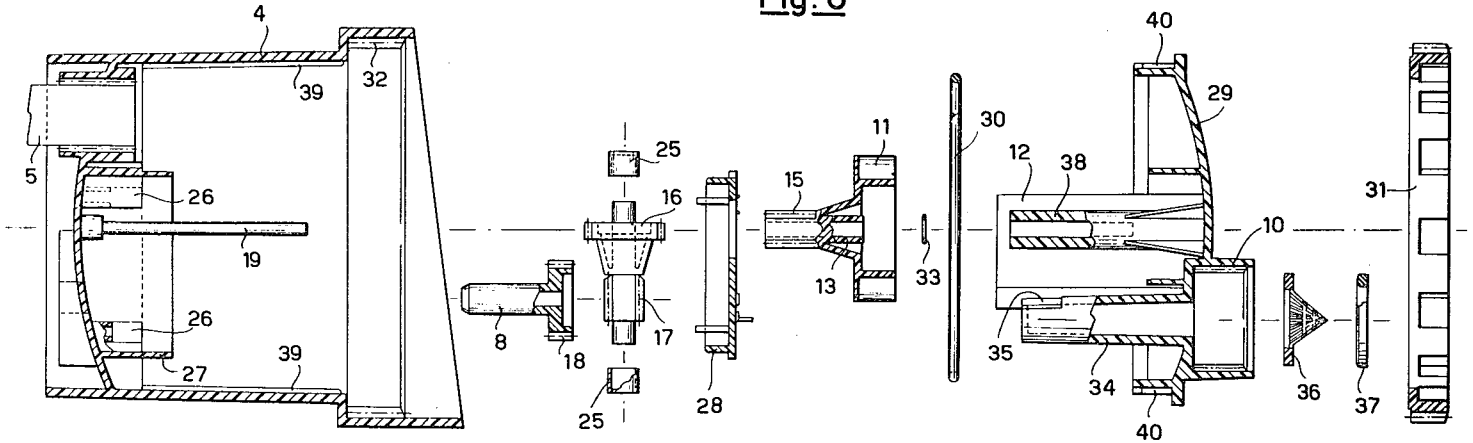
FIG. 6 shows the box in an exploded axial cross-sectional view.

As shown in FIGS. 3 and 5, the assembly 16-17 is merely inserted with the intermediary of two end bushings 25, without any fastening means, between two housings 26 which are formed in the interior of a cylindrical casing 27. Casing 27 has a closing plate 28 (through which the rotor arbor of 11 is passed) and has also the function of holding in the correct position the drive-transfer set 16-17. The plate 28, in its turn, is held in position by the conveyance wall 12, which is integral with a lid 29 of the box 4, the lid being slidable along cooperating guides 39, 40. The wall 12 projects from the lid 29 to such an extent that it abuts the plate 28 when the lid 29 is in the closure position of FIG. 3, an annular gasket 30 being interposed, and lid 29 is prevented from being slipped out by an externally screw-threaded ring 31 (FIGS. 2 and 3) which screwably engages an internal tap 32 of the rear end of the box.

The lid 29 has also integral therewith a tubular sleeve 38 which, when the lid is closed, receives and supports for rotation (FIGS. 3 and 4) the pin 19 which is extended thereinto until providing, through a washer 33, an abutting relationship with the rotor 11 to prevent the latter from being unthreaded from the pin 19.

Lastly, the lid 29 has integral therewith the inlet 10 (FIGS. 2 and 3) which is extended into the interior of the box 4 by a tubular extension 34 which is terminated by a lateral opening 35 in the space confined between the rotor 11 and the conveying wall 12, the latter wall, in its turn, being extended laterally from the extension 34. In the interior of the inlet 10 a wave-breaker member 36 is positioned, which is held in position by a ring 37. The inside wall of the inlet is tapped to permit the insertion of an appropriate water hose and fitting.

The structure as described in the foregoing operates as follows, with reference to the sprinkler shown in the drawings. Water fed to the inlet 10 reaches through the tubular extension 34 and the end opening 35, the turbine composed by the rotor 11 and the conveying wall 12, thus originating the swinging motion of the rocking arm 5 via the rotor 11, the gears 15-18, the output shaft 8, the crank mechanism 9, 14, 20, 21 and the overhanging journal 24. At the same time, water is also fed to the interior of the swinging arm 5 and thus dispensed outwards through the nozzles 7.

If maintenance of the mechanism placed inside the box 4 or the replacement of a few of them is required, it is possible to have access to such mechanisms in a quick and simple manner by unscrewing the retainer ring 31 and slipping the lid 29. The rotor 11 can thus be slipped, in its turn, out of the pin 19, thus permitting the removal of the plate 28 and the resultant access to the transfer gears 15-18, the member 16-17 of which can be slipped, in its turn, from the seats 26 thereof. The reverse manipulations which are likewise simple and quick, must be carried out in the assemblage stage.

I claim:

1. Rocking-arm lawn sprinkler for lawns, fields, gardens and cultivated land in general, of the kind comprising a tubular rocking arm with radial perforations therethrough and with a closed end and the opposite end fed with irrigation water and substained for rotation by a box containing a motion-producing system actuated by said irrigation water, characterized in that said box has a rear lid which has a circular periphery fitted into a circular aperture in said box, and an exteriorly threaded retaining ring threaded into mating threads on the periphery of said aperture whereby upon removal of said retaining ring said lid can be slipped out of said aperture for giving access to said motion producing system.

2. Lawn sprinkler according to claim 1, characterized in that said motion producing system comprises a turbine with a rotor slipped in a freely rotatable manner on a supporting arbor parallel to the direction of unslipping of said lid and a set of drive-transfer gears adapted to receive the drive from said rotor and to transfer it in the form of rotary continuous motion to an output shaft mechanically connected to the rocking arm by a crank mechanism, said gear set being housed in a casing integral with said box and equipped with a closure plate and that said turbine includes a water-conveying wall integral with said lid and projecting therefrom to such an extent as to retain, when the lid is closed, said plate in the closed-position, said lid having also integral therewith a tubular sleeve which, when the lid is closed, receives and supports for rotation said supporting arbor for the rotor and is extended thereon so as to provide an abutting relationship with the rotor to retain the latter against its being slipped out of said arbor.

3. Lawn sprinkler according to claim 2, characterized in that through said lid an irrigation water feeding port is provided which is extended into the interior of a tubular extension of the lid which is extended to the vicinity of the internal end of the conveying wall aforesaid.

4. A lawn sprinkler according to claim 2, characterized in that said gear set comprises a first worm rotatable coaxially and integrally with said rotor, a first pinion cooperating with said first worm, a second worm integral and coaxial with said first pinion, and a second pinion mounted integrally with said output shaft, said first pinion and said second worm being arranged with their common axis perpendicular to the parallel axes of said first worm and said second pinion and being held in position against transversal movements only by said closure plate of the casing which houses said gear set.

* * * * *